United States Patent [19]

Wessner

[11] 4,007,383

[45] Feb. 8, 1977

[54] POSITION DETERMINING DEVICE

[75] Inventor: Harald Wessner, Neunkirchen, Austria

[73] Assignees: Karl Vockenhuber; Raimund Hauser, both of Vienna, Austria

[22] Filed: Jan. 26, 1976

[21] Appl. No.: 652,045

[30] Foreign Application Priority Data

Jan. 27, 1975 Austria ..... 566/75

[52] U.S. Cl. ..... 250/237 G; 250/231 R; 356/169

[51] Int. Cl.[2] ..... H01J 3/14

[58] Field of Search ..... 250/231 R, 231 SE, 237 G, 250/225; 356/169, 170; 324/175; 340/347 P, 365 P

[56] References Cited

UNITED STATES PATENTS 3,784,833 1/1974 Kimura ..... 356/169

3,842,261 10/1974 MacGovern et al. ..... 250/237 G

*Primary Examiner*—David C. Nelms

*Attorney, Agent, or Firm*—Fleit & Jacobson

[57] ABSTRACT

A device for determining the position of at least two objects movable relative to each other preferably in a pre-set counter train which includes operatively associated optical elements supported on the objects together with a transmitter for emitting a directional beam such as an electromagnetic wave transmitter for producing an electromagnetic beam and a receiver onto which the beam is directed, the beam being directed in a unidirectional path onto the receiver when the optical elements are in a predetermined aligned position and being deflected from such path to an extent corresponding to the relative position of the objects and the optical elements supported thereon to provide an output from the receiver responsive to relative position of the objects.

4 Claims, 8 Drawing Figures

FIG. 1a
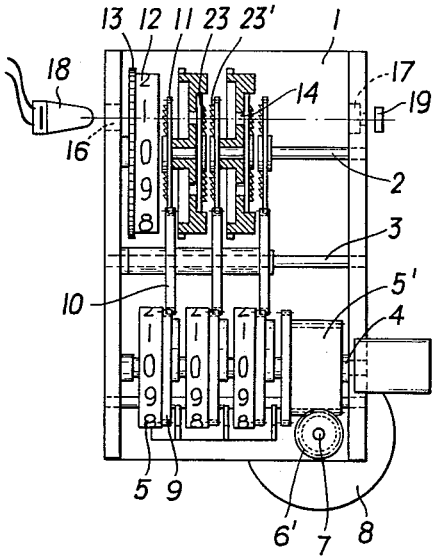
FIG. 1b
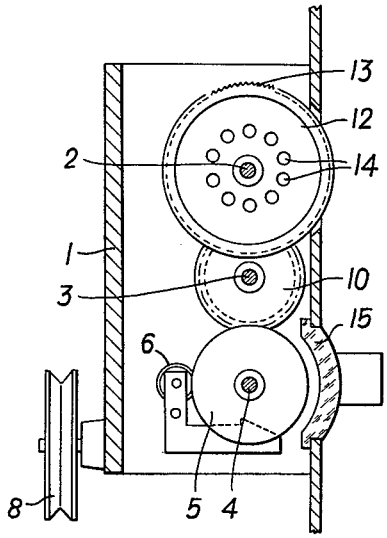
FIG. 2a
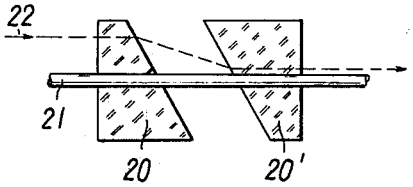
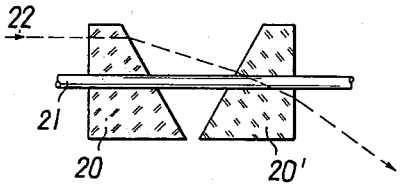
FIG. 2b
FIG. 3a
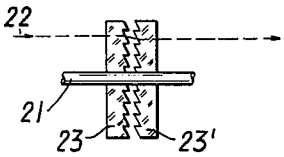
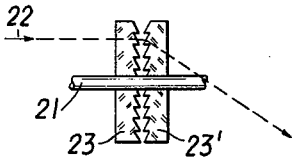
FIG. 3b

POSITION DETERMINING DEVICE

BACKGROUND OF THE INVENTION

This invention relates to position sensing devices and more particularly to a device for optically sensing the relative position of two or more movable devices.

Devices for determining the position of at least two objects movable relative to each other are in use in various fields of technology. For example, one application of such devices involves the sorting out from a number of objects those which possess identical properties and which are therefore provided with identical markers or flags. Devices in this category include index card files provided with hole-punched tabs in which the index cards are arranged in a package. By the use of a rod, those index cards whose tabs are in alignment with one another may be simultaneously removed. Another type of such well-known devices are what is referred to as "numerical locks" consisting of a set of numbered dials having a central hole and circumferentially spaced, peripheral notches. If all the notches of the set of dials are in alignment, a lug with a radial mandrel may be inserted in the aligned holes. Preadjusted drum-type counters operate on a similar principle. Also, well-known is a positioning and controlling device utilizing perforated tapes, with which a free-flowing medium, preferably a pressurized gas, is used as a flag sensor.

Devices having mechanical sensing of flags operate in a purely "static" manner, i.e., changes in position of the individual objects or elements (index cards, discs, etc.) remain undetected for a period of time and such changes can only be determined by experimental introduction of a test rod or the like or they are not of any practical use as long as the test rod is introduced. On the other hand, mechanisms employing a free-flowing medium operate "dynamically", that is, the individual elements can move freely towards each other so that a particular relative position of the elements is determined while "in motion". Nevertheless, to use such a free-flowing medium as for example, pressurized gas, the provision of a large number of auxiliary devices is required which makes such a system relatively stationary, requiring monitoring, and such a system is not only likely to malfunction but is expensive.

As a matter of fact, pre-set counters of the above mentioned type are commercially available and include optical elements formed by a pin diaphragm. However, only when the apertures of these pin diaphragms are in alignment, thus allowing the energy beam to pass through, is the desired position attained. In general, such devices require that the desired position be set at first, and thereafter the counter set at "0". In this way, the desired position is marked by the zero positioning of the counter, and could at any time be located. The drawback of such a system is that it is first necessary to seek out the desired position in order to be able to mark it. In the case of magnetic equipment, it is often necessary from the outset to provide specific well-known counters so that a specific musical transmission or the like begins on a specific tape. In another well-known design, it has been suggested that the apertures of the pin diaphragms be put at optional points corresponding to a specific position, for example. Here again, the disadvantage is that once the apertures have been made, they are not readily interchangeable, so that when used on magnetic tape equipment, a specific position can certainly be detected in such a mechanical memory device but not different positions, such as would be required for different magnetic tapes.

In accordance with the invention, a device of the above-mentioned type has been provided which does not have the disadvantages of such previously known devices. According to the invention, this is accomplished by providing optical elements such as deflecting prisms associated in adjustable pairs and supported on the objects such as in a counter particularly for deflecting an energy beam whereby a deflecting element of an object is associated with another deflecting element such as the element of pre-set disc to form a pair of such elements in such a way that the energy beam is directed to a receiver only when the adjusted position of the disc and the position of the object coincide. By so doing, any position may be pre-set or determined without any concern with the zero position or some other predetermined position. With the invention, visible or invisible light, laser beams or even collected high frequency beams may be employed to serve as an electromagnetic beam.

BRIEF DESCRIPTION OF THE DRAWINGS

These and other objects of the invention, as well as many of the attendant advantages thereof, will become more readily apparent when reference is made to the following description taken in conjunction with the accompanying drawings.

FIG. 1*a* is a front elevation view of a drum-type counter incorporating the position determining device of the invention;

FIG. 1*b* is a side elevation view of the counter of FIG. 1*a;*

FIG. 2*a* is a side elevation view of the optical elements incorporated in the invention in one operating position;

FIG. 2*b* is a view similar to FIG. 2*a* illustrates the optical elements in another operating position;

FIG. 3*a* is a view similar to FIG. 2*a* illustrating another form of the optical elements of the invention in one operating position;

FIG. 3*b* is a view similar to FIG. 3*a* illustrating the optical elements in another operating position;

DESCRIPTION OF THE PREFERRED EMBODIMENTS

Figure 4:
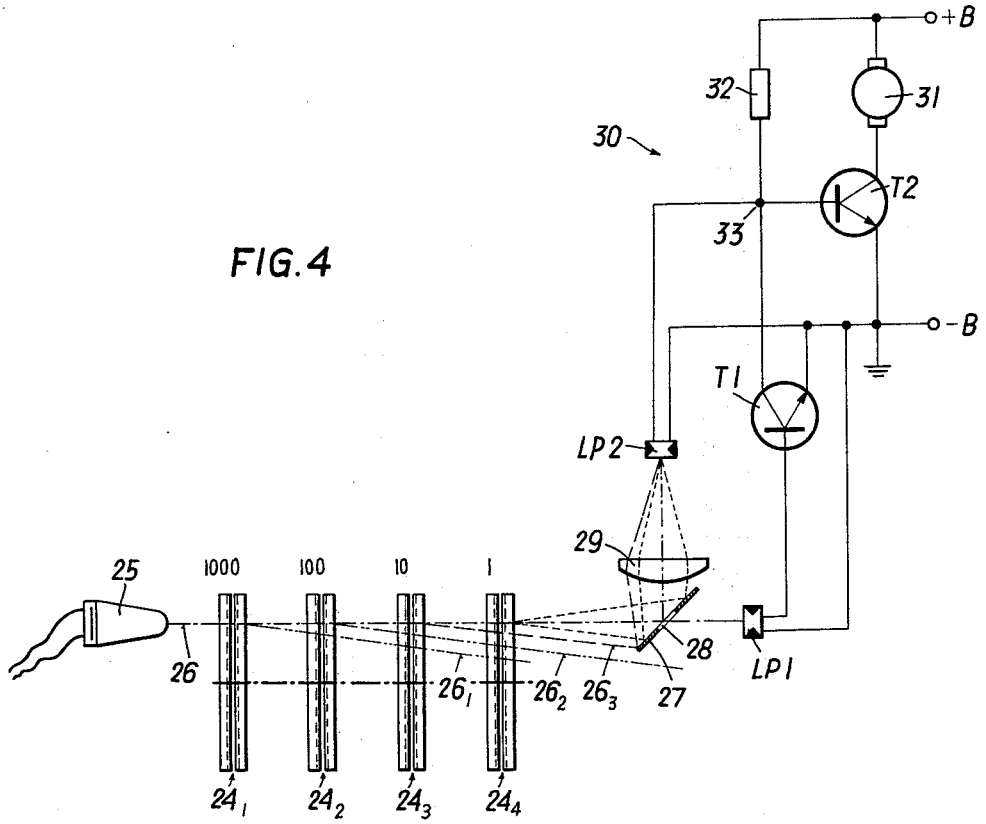
FIG. 4 is a schematic diagram of a device similar to that of FIG. 1*a* together with associated circuitry.

FIGS. 1*a* and 1*b* show a drum-type counter mechanism, constructed in accordance with the invention. The counter mechanism of FIGS. 1*a* and 1*b* includes a frame 1 in which are supported three shafts, 2, 3, and 4, arranged in vertically spaced relationship. The lower shaft 4 carries a plurality of conventional numbered cylinders 5 with an associated decimal switching device. The shaft 4 also carries a drive pinion 5' arranged to engage the numbered cylinder 5 of the lowest place value. The drive pinion 5' meshes with a worm gear secured to a drive shaft 7 on which a drive-cord roller 8 is mounted. Each numbered cylinder 5 is connected to a gear wheel 9 for rotation therewith and the gear wheels 9 may be formed integrally with their associated cylinder 5, if desired. Each of the gear wheels 9 mesh with an idling gear 10 loosely mounted on shaft 3.

A plurality of numbered cylinders 12 are rotatably mounted on shaft 2 each for selective rotation independently of each other. Each of the cylinders 12 is provided with a knurled disc 13 by means of which the cylinders 12 may be manually rotated. Access to the disc 13 is provided by an opening in the frame 1 through which the discs 13 project as shown best in FIG. 1*b*. Each of the numbered cylinders 12 is provided with a plurality of circumferentially spaced perforations 14 each of which correspond to a number on the cylinder 12.

A plurality of gear wheels 11 are also provided on the shaft 2, each of the gear wheels 11 being associated with one of the numbered cylinders 12. The gear wheels 11 are each arranged in meshing engagement with one of the intermediate gears 10 on shaft 3. The intermediate gears 10 are thus arranged to transmit the rotation of the lower numbered cylinders 5 to the upper gear wheels 11. The set of lower numbered counters 5 is mounted behind a transparent cover 15 suitably mounted on the frame 1 so as to permit the numbers on cylinders 5 to be read by the naked eye. The upper set of numbered cylinders 12 serve as a presetting device for a numerical combination which when reached during a counting run registered on the numbered cylinders 5 brings about an output signal as will be explained hereinafter for control of similar purposes.

In order to produce such an output signal, the opposite side panels of frame 1 are provided with apertures 16, 17 as shown best in FIG. 1. These apertures 16, 17 are positioned in frame 1 at a level corresponding to the uppermost perforation 14 in the circularly arranged perforations 14 in the numbered cylinders 12. Thus, with this arrangement of the apertures 16, 17, there is provided an unobstructed view through the aligned perforations 14 of the numbered cylinder 12 in each of their counting positions. A transmitter such as a focusing light source 18 for emitting a beam of radiation or electromagnetic energy is disposed adjacent the aperture 16 and a receiver such as a photosensitive cell 19 is positioned adjacent the aperture 17 for receiving the energy beam from the transmitter 18. An optical arrangement comprising a pair of optical elements is associated with each associated numbered cylinder 12 and gear wheel 11.

More specifically, this optical arrangement can be understood by reference to FIGS. 2*a*, 2*b*, 3*a* and 3*b* wherein the basic principle of the optical system of the invention can be seen. As shown in FIG. 2*a*, two prisms in the form of unsymmetrical wedges 20, 20′ are mounted on a shaft 21. If both prisms 20, 20′ are located in the relative position as shown in FIG. 2*a* where the wedge surfaces lie parallel to each other, an incident light ray 22 is deflected by the prisms in a parallel manner. Now, if one of the prisms 20, 20′ on shaft 21 is rotated 180° resulting in the positioning of the prisms 20, 20′ as shown in FIG. 2*b*, the incident ray of light is deflected laterally. The same effect takes place with transparent discs 23, 23′, the adjacent side faces of which are provided with a set of prisms parallel to one another in the shape of unsymmetrical wedges.

The transparent prism discs 23, 23′ are connected to each numbered cylinder 12 and associated gear wheel 11 respectively so that in the zero position of all of the numbered cylinders 5 and 12, each pair of discs 23, 23′ occupies the position shown in FIG. 3*a*. It should be pointed out here that gear wheels 11 are provided with perforations such as perforations 14 of the numbered cylinders 12 or must be made of transparent material.

Therefore, the indicated setting of the numbered cylinders 5, 12 at a zero reading results in an unobstructed field of view between light source 18 and photosensitive cell 19 and thus produces an initial output signal from cell 19. If a different numerical combination is introduced by rotating the numbered cylinders 12 through knurled discs 13, the unobstructed field of view between the light source 18 and cell 19 will not appear until the numbered cylinders 5 indicate this numerical combination and the gear wheels 11 have been rotated with their optical elements 23′ to correspond to this numerical combination. At this point, the associated pairs of prisms will be disposed on discs 23 and 23′ in the manner shown in FIG. 3*a* and permit an uninterrupted passage of the light from the source 18.

It should be emphasized that for a simple determination of alignment, several objects arranged side-by-side or in series must be provided with perforations, screens, lenses, etc. corresponding to their nominal position which in such case effect the energy beam in a position of alignment.

FIG. 4 shows an arrangement similar to FIG. 1 wherein refracting optical elements $24_1$ - $24_4$ are provided with optical pairs in series and representing units of 1000's, 100's, 10's and 1's respectively. The arrangement of FIG. 4 is of the type for determining a condition such as a number with respect to a place value, a standard size or the like. The elements $24_1$ - $24_4$ may be constructed so as to utilize the arrangement shown in FIGS. 3*a* and 3*b*.

At the entrance of this series of optical element pairs, a focusing light source 25, which emits a light ray 26 perpendicular to the main surfaces of the elements, is provided. Behind elements $24_1$ - $24_4$ is a deflecting mirror 27 in alignment with light source 25 and this deflecting mirror 27 is provided with a central opening 28. Behind deflecting mirror 27 and also in alignment with light source 25 is positioned a first photosensitive cell LP1. In the deflected beam path of mirror 27, a second photosensitive cell LP2 is positioned with an optical device 29 such as a light converging lens between the mirror 27 and cell LP2.

An electronic circuit 30 including two transistors T1 and T2 is connected to photosensitive cell LP1 and LP2 and is arranged to be connected to an associated source of electric power (not shown) identified by positive and negative terminals +B, −B respectively. The two cells LP1 and LP2 are connected at one side to the terminal −B of the associated voltage source. The other side of cell LP1 is connected to the base of transistor T1, whose emitter is connected to terminal −B and whose collector is connected through resistance 32 to terminal +B. The junction point 33 between resistance 32 and transistor T1 is connected to the other side of cell LP2 and the base of transistor T2, the emitter and collector of which are connected in series with a motor 31 connected to the voltage source at terminals +B, −B.

As described above in reference to FIGS. 3*a*, 3*b*, each pair of prisms $24_1$ - $24_4$ produces different deflections of a unidirectional light ray in accordance with their relative position. In a series tandem arrangement of such pairs according to FIG. 4, there is produced different (more or less) deflected beam paths 26, $26_2$, $26_3$, etc. according to the relative position of the optical elements which strike mirror 27 to a greater or lesser degree. If all of the prism pairs are in the position shown in FIG. 3*a*, the light ray 26 is directed straight through the prism series and through the opening 28 in mirror 27 without any deflection of the ray by the mirror. The further the beam is deflected from the straight line ($26_3$-$26_2$-$26_1$) as a result of the relative rotation of the prisms, the amount of light passing through the mirror opening 28 decreases so that the amount of light deflected by the mirror 27 increases. However, the output signals of the photosensitive cells LP1 and LP2 also changes in the same ratio.

In the operation of circuit 30, the two transistors T1 and T2 forms a variable series resistor for motor 31 whereas transistor T1 along with resistance 32 forms a variable voltage divider which, on being tapped at 33, supplies the base voltage of transistor T2. If cell LP1 is fully illuminated and cell LP2 completely dark, cell LP1 delivers its maximum voltage to transistor T1 and transistor T1 becomes conductive. The result is that the voltage at tap 33 becomes the voltage −B of the supply voltage source and transistor T2 is blocked. Under decreasing illumination of cell LP1, the voltage at the base of transistor T1 drops while its resistance increases more and more so that the base voltage of the transistor T2 becomes more positive and transistor T2 becomes increasingly conductive, thereby starting and accelerating motor 31. At the same time, the illumination of cell LP2 increases as well as its output voltage which it supplies to the base of transistor T2. Then at a specific exposure to light of both cells LP and LP2, cell LP2 alone assumes control of the motor 31 which operates under full illumination of cell LP2 and complete darkness of cell LP1 in a running condition.

With a suitable selection of the elements of the circuit 30, cell LP2 can be employed to control the motor 31 practically by itself while transistor T1 in practice switches the control on and off periodically, namely, at the moment when the light ray strikes cell LP1 only, i.e., when the prisms pairs $24_1$ - $24_4$ are in their position of alignment. However, this is to be expected if, by way of example, a number allocated to one of the prism pairs $24_1$ - $24_4$ reaches a predetermined value or if the standard sizes assigned to the prism pairs have assumed a predetermined relationship.

Figure 5:
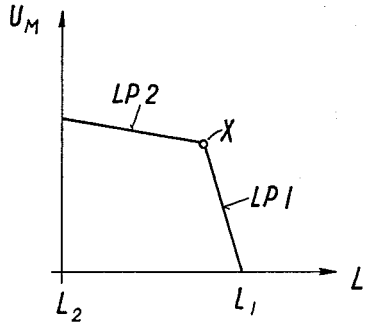
FIG. 5 is a curve illustrating the operating characteristics of the arrangement of FIG. 4.

FIG. 5 shows in diagrammatic form, the mode of operation of the electronic circuit 30 according to FIG. 4. On the absissa of the diagram of FIG. 5 is plotted the exposure intensity L and the motor voltage $U_M$ is plotted on the ordinate. From the right-hand absissa point $L_1$ which gives the maximum light exposure on cell LP1, the voltage curve of motor 31 quickly rises primarily as a result of the aforementioned increase in resistance of transistor T1. The motor voltage portion of the curve of FIG. 5 is mainly determined by cell LP1 and is therefore designated LP1. The portion of the curve from point X on the motor voltage line LP1 up to the complete exposure to light of cell LP2, shown on the absissa by L2, is designated LP2.

Since curve LP1 can be applied very steeply, if need be, it is possible as already indicated, to leave control of the motor 31 completely to cell LP2 and assign to cell LP1 merely the function of switching the motor 31 on and off.

What is claimed is:

1. A position determining device comprising, in combination, at least one pair of objects arranged for relative movement in a pre-set counter train, an optical element on each of said objects, a transmitter for generating an energy beam and for directing said beam in a predetermined path, a receiver for receiving said energy beam, said optical elements being disposed in the path of said energy beam for transmission of said beam to said receiver in an aligned position of said optical elements, said optical elements being arranged to deflect said energy beam in a non-aligned position, one of the objects comprising a rotatably mounted dial movable into a pre-set position, the other object being movable to position the optical element on said other object into said aligned position with the optical element on said one object in said pre-set position for transmission of said energy beam in said predetermined path to said receiver.

2. A position determining device in accordance with claim 1 wherein said optical elements comprise the deflecting prisms, said prisms having wedge-shaped side surfaces disposed in adjacent relationship, said prisms being arranged to permit said energy beam to pass therethrough to said receiver in an aligned position of said wedge-shaped surfaces and to deflect said energy beam in a non-aligned position of said wedge-shaped surfaces.

3. A position determining device in accordance with claim 2 wherein said receiver includes a deflecting mirror having an aperture and disposed in the path of said energy beam, a pair of photoelectric sensors, one of said sensors being arranged to receive the energy beam deflected by said mirror for producing an output signal, the other of said sensors being arranged to receive the energy beam passing through said mirror aperture from producing an output signal, an electronic circuit connected to an associated source of electric power and to said pair of sensors, said electric circuit being arranged to produce a control output voltage in response to the output signals from said pair of sensors.

4. A position determining device in accordance with claim 3 wherein said electronic circuit includes a first transistor and a resistance connected at one side thereto to form a voltage divider, the other side of said resistance being connected to one side of said associated source of electric power, said first transistor being connected between said pair of sensors with its base connected to said other sensor and to the other side of said associated source of electric power, an electric power device connected at one side to said one side of said associated source of electric power, a second transistor serially connected to the other side of said electric power device and to the other side of said associated source of electric power, said second transistor having its base connected to said one sensor and between said first transistor and said resistance.

* * * * *